US005911224A

United States Patent [19]

Berger

[11] Patent Number: 5,911,224

[45] Date of Patent: Jun. 15, 1999

[54] BIODEGRADABLE POLYVINYL ALCOHOL TOBACCO SMOKE FILTERS, TOBACCO SMOKE PRODUCTS INCORPORATING SUCH FILTERS, AND METHODS AND APPARATUS FOR MAKING SAME

[75] Inventor: Richard M. Berger, Midlothian, Va.

[73] Assignee: Filtrona International Limited, London, United Kingdom

[21] Appl. No.: 08/850,006

[22] Filed: May 1, 1997

[51] Int. Cl.[6] ..... D02G 3/00; A24D 3/08

[52] U.S. Cl. ..... 131/332; 131/331; 131/341; 131/342; 428/357; 428/364; 428/131.1; 428/131.5; 493/39; 493/42; 493/49

[58] Field of Search ..... 131/331, 332, 131/341, 342, 343, 88; 428/364, 357, 375, 378, 401; 442/340, 333; 156/166, 167; 425/131.1, 131.5; 493/39, 42, 49

[56] References Cited

U.S. PATENT DOCUMENTS

| | | | |
|---|---|---|---|
| 3,095,343 | 6/1963 | Berger . | |
| 3,417,758 | 12/1968 | Sloan et al. . | |
| 3,455,766 | 7/1969 | Berger et al. . | |
| 3,595,245 | 7/1971 | Buntin et al. . | |
| 3,615,480 | 10/1971 | Lam . | |
| 3,615,995 | 10/1971 | Buntin et al. . | |
| 3,616,603 | 11/1971 | Warner . | |
| 3,637,447 | 1/1972 | Berger et al. . | |
| 3,825,379 | 7/1974 | Lohkamp et al. . | |
| 4,286,005 | 8/1981 | Berger . | |
| 4,355,995 | 10/1982 | Berger . | |
| 4,380,570 | 4/1983 | Schwarz . | |
| 4,729,808 | 3/1988 | Berger . | |
| 4,731,215 | 3/1988 | Schwarz . | |
| 5,021,288 | 6/1991 | Jezic . | |
| 5,207,387 | 5/1993 | Honeycutt . | |
| 5,290,626 | 3/1994 | Nishio et al. . | |
| 5,342,335 | 8/1994 | Rhim . | |
| 5,362,778 | 11/1994 | Famili et al. . | |
| 5,427,852 | 6/1995 | Teufel et al. . | |
| 5,445,785 | 8/1995 | Rhim . | |
| 5,453,144 | 9/1995 | Kauffman et al. . | |
| 5,455,114 | 10/1995 | Ohmory et al. | 428/367 |
| 5,462,801 | 10/1995 | Willmund . | |
| 5,478,386 | 12/1995 | Itoh et al. . | |
| 5,495,860 | 3/1996 | Teufel et al. . | |
| 5,497,793 | 3/1996 | Kubica . | |
| 5,509,430 | 4/1996 | Berger | 131/341 |

OTHER PUBLICATIONS

Richmond Times Dispatch article, July 25, 1994, entitled Father, son pack their hopes around product.".

Dever et al., "Development and Evaluation of Water Soluble Melt Blown Nonwovens", INDA JNR, vol. 5, No. 2, pp. 27–33.

Sell sheet entitled "Envirofill, Loose–fill Packaging Material" for EnPac.

*Primary Examiner*—Stanley S. Silverman
*Assistant Examiner*—Steven B. Leavitt
*Attorney, Agent, or Firm*—Jacobson, Price, Holman & Stern, PLLC

[57] ABSTRACT

A porous element particularly for use as a tobacco smoke filter plug in association with a cigarette or the like wherein the matrix comprises a multiplicity of biodegradable polyvinyl alcohol fibers bonded together at their points of contact to define a tortuous interstitial path for the passage of smoke. Because of the hygroscopic nature of polyvinyl alcohol, commercial production of such products require careful control of the moisture content of the polyvinyl alcohol fiber starting material, usually pre-drying the same to a residual moisture content of 7% by weight or less, and treatment of the low moisture fibrous mass by superheated steam to add about 2.5 to 5% moisture to a final moisture content of about 2.5 to 10%. The steam renders the fiber surface adhesive and, thus, bondable, and also lubricates the gathered fibers to improve processability.

62 Claims, 3 Drawing Sheets

BIODEGRADABLE POLYVINYL ALCOHOL TOBACCO SMOKE FILTERS, TOBACCO SMOKE PRODUCTS INCORPORATING SUCH FILTERS, AND METHODS AND APPARATUS FOR MAKING SAME

This invention relates to unique tobacco smoke filters or the like and methods and apparatus for making such products, and relates more particularly to tobacco smoke filters wherein the primary matrix defining a tortuous interstitial path for passage of smoke therethrough is formed by continuous fibers consisting essentially of polyvinyl alcohol bonded to each other at spaced points of contact, such that the bonded contact points and the entire fibrous matrix will rapidly disintegrate when subjected to environmental conditions.

BACKGROUND OF THE INVENTION

A problem with currently available tobacco smoke filters, particularly cigarette filters, is the difficulty of disposing of such materials after use. With limited exceptions, cigarette filters are presently formed from highly crimped cellulose acetate fibers bonded at their contact points to provide a significant volume of interstitial space for the passage of smoke. The bonded contact points of such filter elements degrade very slowly under normal environmental conditions resulting in high volume, long life, environmentally undesirable litter. The cellulose acetate fibers themselves are, for all intents and purposes, effectively not biodegradable.

Certain polymeric materials such as polyvinyl alcohol and ethylene vinyl alcohol copolymers are known to readily soften or dissolve in the presence of water. Berger U.S. Pat. No. 5,509,430, the subject matter of which is incorporated herein in its entirety, discloses the production of tobacco smoke filters from bicomponent fibers utilizing a sheath of polyvinyl alcohol or ethylene vinyl alcohol copolymer and a core of a thermoplastic polymer such as polypropylene. The sheath-forming materials of the bicomponent fibers used to make tobacco smoke filters according to the No. '430 patent will dissolve in the presence of environmental moisture, degrading the bonds between the fibers and resulting in the collapse of the matrix structure, while leaving behind a multiplicity of non-degraded core fibers.

Thus, while filter elements utilizing bicomponent fibers according to the No. '430 patent provide a substantial improvement in reducing the bulk of environmental litter from tobacco smoke filter elements, it would obviously be desirable to be able to produce tobacco smoke filter elements wherein the fibrous matrix is substantially entirely biodegradable. Yet, current technology has been unable to resolve the inherent conflict in producing a product that will substantially totally disintegrate in the presence of environmental water when it has served its purpose, while retaining its structural integrity during and after a manufacturing process which, of necessity, takes place in the presence of moisture.

Polyvinyl alcohol is unique in being the only biodegradable, carbon-carbon backbone polymer that can completely biodegrade to small molecules, e.g., carbon dioxide and water, under conditions found in typical waste treatment facilities and under soil burial conditions. Polyvinyl alcohol is commercially available as a thermoplastic, water soluble, solid polymer that is relatively inexpensive and non-toxic. Conventionally, polyvinyl alcohol is made by hydrolyzing polyvinyl acetate to selectively remove acetate groups from the polymer chain and replace the acetate groups with hydroxyl groups. Generally, complete or near complete conversion increases the crystallinity of the polymer resulting in polyvinyl alcohol which is more difficult to completely dissolve in cold water Intermediate hydrolysis grades (those less than 90% and greater than 65%) exhibit good cold water solubility and allow a product made therefrom to disintegrate rapidly in the presence of environmental moisture or at a waste disposal site. In contrast, fully hydrolyzed grades (those greater than 98%) impart good strength in cold water, but do not dissolve rapidly upon disposal. By varying the chain length of the polyvinyl acetate starting material and controlling the hydrolysis using well known techniques, polyvinyl alcohol having carefully selected properties can be realized. This invention is primarily concerned with polyvinyl alcohol starting materials having less than about 95%, optimally less than 90%, and more than about 65%, of its acetate groups replaced by hydroxyl groups.

Filtration efficiency, i.e., the ability to remove undesirable constituents from tobacco smoke, is obviously one of the most important properties of materials used in the production of tobacco smoke filters. Heretofore, high levels of filtration have often had to be compromised in order to satisfy other commercially important factors such as impact on taste, resistance to draw, hardness and manufacturing costs. Tobacco smoke filters formed of polyvinyl alcohol fibers have been found to provide excellent filtration efficiency and commercially acceptable taste properties. However, because of the hygroscopicity of polyvinyl alcohol, prior art attempts to process such materials have resulted in filter rods which are too soft to be efficiently handled in high speed cigarette manufacturing machines. Moreover, cigarette filter elements formed from such materials have failed to provide a sufficiently stable porous matrix to permit proper draw characteristics and avoid collapse in use.

While bicomponent fibers comprising a thin sheath of polyvinyl alcohol supported by a relatively non-degradable core such as polypropylene, as described in the aforementioned No. '430 patent, can be processed into a relatively self-sustaining porous rod useful in the production of tobacco smoke filters and the like, attempts heretofore to utilize fibers formed substantially entirely of polyvinyl alcohol have been unsuccessful. The instant invention, utilizing unique technology, has overcome these problems, enabling the high speed production of substantially totally biodegradable tobacco smoke filter elements that can be readily processed by state of the art cigarette-making machines with commercially acceptable hardness and resistance to draw, good taste, and filtration efficiency (total particulate matter retention) equal to or better than currently available tobacco smoke filters formed from cellulose acetate tow.

As discussed in the aforementioned No. '430 patent, it is known that filtration efficiency can be increased through the use of fine fibers which provide increased surface area at the same fiber weight. Solvent-spun cellulose acetate fibers are commercially available only in fiber sizes down to 13 microns in diameter. To obtain finer cellulose acetate homopolymer fibers, e.g., 10 microns or less, melt spinning of plasticized cellulose acetate resin would be required; however, the level of plasticizer necessary to directly spin such fine cellulose acetate fibers would render the resultant fibers very weak and commercially useless. Melt spun cellulose acetate fibers of a larger diameter, which would require less plasticizer, would have to be drawn and crimped to produce such fine fibers for use in tobacco smoke filters. Unfortunately, melt spun cellulose acetate fibers can only be commercially drawn at relatively low draw ratios before the fibers break during processing. The inability to form and process very fine fibers of cellulose acetate places practical limits on the filtration efficiency capabilities of this material in the production of tobacco smoke filters.

One solution to this problem is the use of the bicomponent fibers disclosed in the No. '430 patent since such fibers, even with a cellulose acetate sheath, can be melt blown to produce very fine fibers, on the order of 10 microns or less, even as low as 1 micron. In the melt blowing process, a molten thermoplastic polymer is forced through a spinnerette or the like to form a multiplicity of continuous fibers. As the molten fibers exit the die, they are impacted by a high velocity stream of hot primary gas, such as air, that mixes with ambient air, resulting in a turbulent stream that rapidly attenuates and solidifies the fibers which are collected in an entangled mass or web.

Research at the University of Tennessee has shown that fibers consisting essentially of partially hydrolyzed (less than 90%) polyvinyl alcohol can be melt blown successfully. See "Development and Evaluation of Water Soluble Melt Blown Nonwovens", Maureen Deever, Roberto S. Benson and Nancy Fair, *INDA JNR,* Volume 5, No. 2, pp. 27–33, incorporated herein in its entirety. The University of Tennessee research was principally directed to the production of non-woven fabrics formed of melt blown polyvinyl alcohol fibers. The *INDA JNR* article suggests two chemical treatments for moderating the water solubility of such materials in order to make them useful for such applications: 1) mixing a fluorochemical melt additive with the polyvinyl alcohol resin before melt blowing, or 2) applying an organic solvent-based water-repellent finish to the polyvinyl alcohol non-woven material as a post-treatment. Both methods reduce the rate of cold water solubility of the pure polyvinyl alcohol melt blown material, neither process would be acceptable in the commercial production of tobacco smoke filters from polyvinyl alcohol fibers.

Another technique for forming a non-woven web of fine polyvinyl alcohol fibers, from 0.1 to 30 microns in mean fiber diameter, is disclosed in Rhim U.S. Pat. Nos. 5,342,335 and 5,445,785, the disclosures of each of which are incorporated herein in their entirety by reference. Rhim extrudes polyvinyl alcohol fibers from an aqueous solution, rather than a melt, attenuates the fibers with a gaseous source, dries the attenuated fibers, and then deposits them randomly on a moving foraminous surface much like a melt blowing process.

While solution spinning and attenuation of polyvinyl alcohol to produce fine fibers can provide an acceptable starting material for the process of the instant invention; melt blowing extruded polyvinyl alcohol fibers is preferred. Various prior art melt blowing processes and appartus can be used for this purpose. For example, reference is made to Buntin, U.S. Pat. Nos. 3,595,245 and 3,615,995, Schwarz, U.S. Pat. Nos. 4,380,570 and 4,731,215, Lohkamp et al., U.S. Pat. No. 3,825,379, and Jezic U.S. Pat. No. 5,021,288, the entire subject matter of each of which is incorporated herein for further background in this technology.

The method of manufacturing the polyvinyl alcohol polymer or the fiber used in the production of tobacco smoke filters is not part of the instant invention, except as described herein. Processes for making polyvinyl alcohol polymers and for forming fibers therefrom are well known in the art and most commercially available polyvinyl alcohol fibers can be used if processed according to the instant inventive concepts. Thus, while increased surface area resulting from attenuating polyvinyl alcohol fibers as they are extruded in a melt blowing or solution spinning process provides better filtration properties in the final product, according to the broader concepts of this invention the polyvinyl alcohol fibers can be melt spun or spun bonded or otherwise formed in accordance with any conventional and well-known fiber-forming techniques. Consistent therewith, for example, melt spun or spun bonded polyvinyl alcohol fibers having an average diameter of from about 10 to 30 microns may desirably be used to form tobacco smoke filters according to this invention, although melt blown or solution spun polyvinyl alcohol fibers having an average diameter of about 10 microns or less are particularly advantageous because of their high surface area.

While tobacco smoke filters formed of fibers consisting entirely of polyvinyl alcohol homopolymer are unique and commercially desirable, the polyvinyl alcohol polymer used in the formation of the fibers may include some quantities of other substances inherent in such materials and/or additives necessary or desirable to facilitate commercial production requirements. Reference herein and in the accompanying claims to the continuous fibers from which the porous matrix of the tobacco smoke filters of the instant invention are formed as "consisting essentially of polyvinyl alcohol" is intended to encompass the presence of small amounts of other materials which do not significantly affect the nature or function of the polyvinyl alcohol in the formation of porous elements, or their use as tobacco smoke filters, according to this invention.

Likewise, while it may be highly desirable to produce tobacco smoke filter elements wherein the porous matrix is formed entirely of polyvinyl alcohol fibers, minor proportions of other polymeric fibers or materials, including cellulose acetate fibers, may be incorporated for special applications. However, to achieve the significant advantages of the instant invention, particularly the biodegradability of the bonds that cause the collapse of the filter matrix in the presence of environmental moisture, and, desirably, the degradation of a major proportion, or even substantially all, of the matrix itself, tobacco smoke filters according to this invention should comprise at least 50% by weight, and preferably 70 to 90% by weight, of fibers consisting essentially of polyvinyl alcohol.

To even further reduce environmental litter, if an overwrap is necessary for integrity, the porous rod used in the formation of tobacco smoke filter elements according to this invention can be encased in a thin sheath of polyvinyl alcohol in lieu of conventional paper plug wrap, thereby enhancing the biodegradability of the entire product.

Various other properties of such filters can be modified or improved by the incorporation of liquid or solid additives during the manufacturing process. For example, non-aqueous flavor-modifying materials such as menthol may be sprayed onto the fiber as it is formed, to provide a menthol flavor to tobacco smoke passing through a filter element in a cigarette or the like incorporating the same.

Fine activated charcoal particles may be added to a web or roving of such fibers, preferably during a melt blowing process, but in any event, before gathering and forming the same into a filter rod, to provide gas phase filtration characteristics to the resulting filter element. Likewise, chopped cellulose acetate fibers or even tobacco particles, can be randomly dispersed in the porous matrix for enhanced taste and other characteristics.

Particles of a biodegradable additive such as a starch, may also be incorporated in a similar manner to increase the hardness of the filter rod, if necessary. Sorghum is a particularly useful starch since it is water soluble, 100% biodegradable, non-toxic, light weight, and rodent and insect neutral. It is also inexpensive, sorghum meal, available from Archer, Daniels, Midland, selling for approximately 25% of the cost of corn starch. Other sources of sorghum useful in the instant invention are packaging materials, such as Envirofill manufactured by Norel, a division of UniSource, and Bifpak available from Virginia Biofoam Co.

Expanded sorghum, produced by treating sorghum meal with heat and pressure and releasing the product through a narrow opening increasing the volume 50-fold, is available from Biofoam. It has been found that such material, when ground and incorporated into the rod-forming web according to this invention, can increase the filtration efficiency of a tobacco smoke filter made therefrom by an additional 5%.

By incorporating a particulate additive in the gas stream of a melt blowing attenuation, uniform dispersion and excellent adherence to the softened surface of the polyvinyl alcohol fibers is effected, reducing the necessity for an additional filter element as is commonly used to preclude loosely adhering additive particles from being drawn into a smoker's mouth, although a filter plug according to the instant invention may be incorporated with other plugs in a multi-filter cigarette for other reasons, if desired.

The porous rod-like elements of this invention may have other applications; however, their use in the formation of tobacco smoke filters is of particular interest. Moreover, while such tobacco smoke filter elements may be associated with cigarettes, cigars or pipes, the primary commercial application of such products relates to their use as filters for cigarettes. Therefore, the following description of the instant inventive concepts will focus on the production of tobacco smoke filter elements for use in filtered cigarettes as exemplary of the broader applications for this invention.

SUMMARY OF THE INVENTION

Accordingly, it is a primary object of this invention to provide porous elements particularly useful as tobacco smoke filters for cigarettes or the like, wherein the fibrous matrix which defines a tortuous interstitial path for passage of smoke therethrough is formed of fibers consisting essentially of polyvinyl alcohol which are substantially totally biodegradable in the presence of environmental moisture.

It is a further object of this invention to provide unique methodology and apparatus for high speed processing of biodegradable polyvinyl alcohol fibers to produce substantially self-sustaining porous tobacco smoke filter elements having excellent taste properties and commercially acceptable hardness and resistance to draw, and which can be readily processed by cigarette-making machines currently in use.

It is another object of the instant inventive concepts to produce tobacco smoke filter elements and the like comprising fibers which consist essentially of readily biodegradable polyvinyl alcohol having diameters, on the average, of 30 microns or less, preferably 10 microns or less. Consistent therewith, according to this invention, polyvinyl alcohol fibers may be extruded and attenuated using conventional melt blowing techniques or solution spinning attenuation as discussed in the aforementioned Rhim patents, but with further processing of a web of such fibers in a unique manner designed to avoid disintegration or deterioration during the formation of an elongated porous rod therefrom.

Another object of this invention is the provision of a tobacco smoke filter or the like formed of a fibrous matrix consisting essentially of polyvinyl alcohol, but incorporating a performance-enhancing additive material including, for example, chopped cellulose acetate fibers, tobacco particles, activated carbon particles, and/or a starch, such as sorghum, preferably ground expanded sorghum, wherein the additive is dispersed throughout the matrix and reliably bonded to the surface of the fibers.

The foregoing and other desiderata are achieved according to the instant inventive concepts by initially selecting a polyvinyl alcohol polymer capable of rapid disintegration in environmental moisture, i.e., in the presence of water at a temperature of at least 32° F. Preferably, the polyvinyl alcohol resin has a hydrolysis level no greater than about 95% and, for practical purposes, no less than about 65%. The molecular weight of the polyvinyl alcohol can vary significantly, acceptable resins being commercially available from various sources.

In forming polyvinyl alcohol fibers from a melt, it generally necessary to reduce the viscosity of the resin by incorporating plasticizers such as polyethylene glycol or glycerol. Such additives increase the inherent hygroscopicity of polyvinyl alcohol under normal environmental conditions resulting in rapid absorption of ambient moisture, commonly in excess of 10% or even as much as 20% or more by weight. Attempts to process such materials into a self-sustaining porous rod or the like, having significant interstitial spaces between the fibers, is difficult at best, and for all intents and purposes, commercially impossible. Subjecting such a fibrous mass to elevated temperatures sufficient to bond decomposes the polyvinyl alcohol resulting in excessive fiber disintegration, poor bonding and significant processing problems precluding satisfactory production of useful product.

In solution spinning such as described in the Rhim patents, the addition of plasticizer is not necessary. Thus, the non-woven webs produced by such processes are less hygroscopic, but care must still be taken if such materials are to be further processed to produce porous rods useful as tobacco smoke filters.

While it is known that simply heating a bundle of polyvinyl alcohol fibers having high residual moisture content cannot produce a porous element with adequate interstitial spaces and acceptable structural stability and hardness for use as a tobacco smoke filter, surprisingly, it has been found that, by carefully controlling the residual moisture in the polyvinyl alcohol fibrous starting material to maintain the same, or reduce the same, to a level of about 7% by weight, preferably about 3–5% or less, before gathering such material into a rod-like form, and then contacting the fibrous bundle with superheated steam at a temperature and pressure in sufficient quantity to add back about 2.5 to 5% moisture, preferably about 3–4%, resulting in a residual moisture content of between about 2.5% and 10%, preferably between about 3–8%, high speed commercial production of acceptable product is realized. In this manner, the fiber surfaces are controllably softened as the gathered fibrous web is passed through the steam treating station. In the absence of carefully controlling the moisture content of the polyvinyl alcohol fibers entering the steam treating station, the moisture added by steam condensation, together with the residual moisture in the starting material, exceeds the level at which the fibrous mass can be heated and effectively processed into a bonded porous product without deteriorating the polymer.

The combination of heat and moisture provided by the steam treatment is believed to function much as a plasticizer does in bonding cellulose acetate in conventional tobacco smoke filter manufacture. Effectively, added moisture resulting from the condensation of the steam when it contacts the gathered fibers, renders the fiber surface adhesive and capable of bonding at points of contact with other fibers. Moreover, the steam also functions to lubricate the gathered web facilitating passage through the heating zone and separation therefrom after cooling.

The steam used in the processing of the rod according to the instant invention supplies the heat and moisture necessary to bond the product; however, if too much moisture is delivered via the steam, the rod will not form properly and may stick to the processing equipment. Preferably, the steam is maintained at a level such that the temperature of the steam die cavity, which is a measure of the actual temperature of the steam as it engages the polyvinyl alcohol fibers, is retained at about 250° to about 350° F. The water vapor in steam at temperatures substantially below about 250° F. will tend to rapidly condense, providing too much moisture to the polyvinyl alcohol fibers; steam die cavity temperatures above about 350° F. are excessive because of the melting of the product.

By bonding the fibrous web through the use of steam, and only steam, the addition of chemicals is obviated producing an environmentally friendly biodegradable product, the remnants of which are those of the components of polyvinyl alcohol, carbon dioxide and water.

If the polyvinyl alcohol fibers are initially produced in a way as to preclude excessive moisture retention, possibly as in the Rhim patents, it may not be necessary to further dry the same before the steam treatment. Also, if the fibers are pre-dried, they can be stored in a moisture free environment, and fed directly to the steam treating station. However, with most manufacturing techniques, and particularly if the polyvinyl alcohol fibers are to be melt blown in-line with the rod-forming equipment, they tend to absorb too much moisture, necessitating a pre-treatment wherein the starting material is dried immediately prior to gathering the same into a rod-like shape to reduce the residual moisture content, and the dried fiber web is then contacted with steam to add moisture and heat, rendering the fibers adhesive so they can bond at their contact points and lubricating the rod as it passes through and from the forming stations.

In the event the fiber-forming process produces a coherent sheet-like web of polyvinyl alcohol fibers, as may result from a solution spinning technique of the type disclosed in the aforementioned Rhim patents, it may be desirable to break down the integrity of the sheet prior to gathering and forming the same into a porous rod according to this invention. Various techniques are known for such processing of sheet-like materials, one useful technique being disclosed in Berger, U.S. Pat. No. 4,286,005, the subject matter of which is incorporated herein by reference. According to the No. '005 patent, the sheet is passed through an embossing station to impress the sheet with a series of parallel grooves. A sheet of polyvinyl alcohol fibers embossed in this manner may then be dried, if necessary, compacted or gathered into a rod-like shape, and further processed according to the instant inventive concepts to form an elongated porous rod.

Accordingly, the preferred process of the instant invention begins with a multiplicity of polyvinyl alcohol fibers produced by conventional melt spun or spun bonded techniques, or more preferably, by melt blowing or solution spinning the same to produce finer fibers, from a polyvinyl alcohol polymer having a hydrolysis level of no less than about 65% and no more than about 95%, the fibrous mass is collected on a foraminous carrier such as a belt or a drum to produce a sheet or web; the web is dried to reduce the residual moisture to 7% by weight or less, if necessary; the dried web is then immediately gathered into a rod-like shape, preferably by wrapping the same in a porous belt; the fiber bundle is carried by the belt through a confined area in a relaxed state wherein superheated steam is passed circumferentially under pressure through the belt into the fibrous mass to heat the fibers and add some moisture from the steam condensate, thereby rendering the surfaces of the fibers adhesive so that the fibers can bond to each other at their points of contact; and the steam-treated porous rod is then cooled to set the fibers in their bonded condition.

The porous rod may be wrapped in a conventional paper plug wrap or, preferably, may be coated with a sheath of polyvinyl alcohol as it is formed to enhance the biodegradability of the filter plugs when they are incorporated into cigarettes or the like. Ultimately, the rod may be subdivided into single or multiple filter elements for combination with a tobacco rod in the conventional formation of filtered cigarettes.

With the foregoing parameters, it is possible to produce porous rods having all of the properties required for use as a tobacco smoke filter, and to run a processing line at the high speeds necessary for commercial production. While the individual parameters cannot be quantified in absolute terms because of the interaction between the various processing conditions, the guidelines herein enable the consistent production of product having acceptable properties at commercial production speeds.

BRIEF DESCRIPTION OF THE DRAWINGS

A better understanding of the present invention, as well as other objects, features and advantages thereof, will become apparent upon consideration of the detailed description herein, in connection with the accompanying drawings wherein.

DESCRIPTION OF THE PREFERRED EMBODIMENTS

Figure 1:
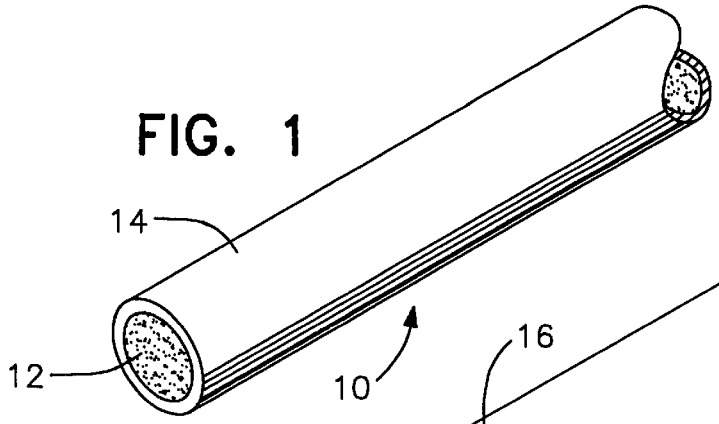
FIG. 1 is an enlarged perspective view of a substantially self-sustaining porous rod formed from fibers consisting essentially of polyvinyl alcohol according to the instant inventive concepts.

The instant inventive concepts are embodied in a substantially self-sustaining porous rod designated generally by the reference numeral 10 in FIG. 1. Although not evident from the schematic showing in FIG. 1, the rod 10 comprises a matrix 12 formed of continuous fibers consisting essentially of biodegradable polyvinyl alcohol bonded to each other at spaced points of contact to define a tortuous interstitial path therethrough, of the type conventionally found in tobacco smoke filters such as incorporated in filtered cigarettes or the like. To the extent that the matrix 12 is not sufficiently self-sustaining for subsequent handling, it may be overwrapped in a well known manner by a conventional paper plug wrap or, according to preferred embodiments of the instant inventive concepts, encased in a biodegradable polyvinyl alcohol sheath designated generally by the reference numeral 14.

It is to be understood that the filter rods produced in accordance with this invention need not be of uniform construction throughout as illustrated herein, but could have interior pockets, exterior grooves, crimped portions or other modifications as shown in prior Berger Pat. Nos. 4,355,995 and 3,637,447, the subject matter of each of which is incorporated herein in its entirety by reference, or others, without departing from the instant inventive concepts.

Figure 2:
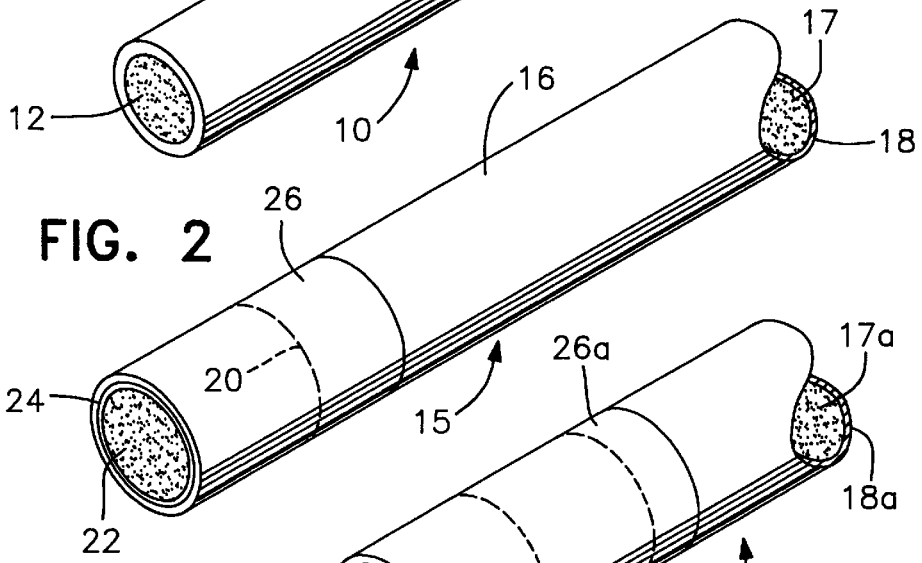
FIG. 2 is a perspective view of a cigarette incorporating a filter element according to this invention.

Portions of a conventional filtered cigarette are illustrated schematically at 15 in FIG. 2 including a tobacco rod 16 comprising tobacco 17 covered by a conventional cigarette paper 18, and a discrete filter element 20, such as would result from subdividing a filter rod of the type seen at 10 in FIG. 1 in any well-known manner.

Commonly, tobacco smoke filter rods such as shown at 10 would initially be cut into dual filter lengths and connected to a pair of tobacco rods on conventional cigarette manufacturing equipment (not shown), then split into two filtered cigarettes. Thus, in the ultimate product, the filtered cigarette 15, the filter element 20 comprises a body 22 of the bonded polyvinyl alcohol fibers overwrapped by a plug wrap or polyvinyl alcohol sheath 24 and is secured to the tobacco rod 16 as by a standard paper tipping wrap 26.

Figure 2A:
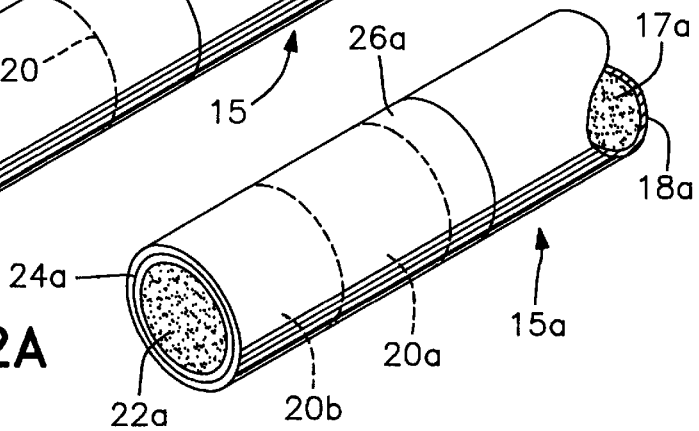
FIG. 2A illustrates a filtered cigarette incorporating more than one filter plug, at least one of which is made by the instant inventive concepts.

Although the use of at least one filter element according to this invention is necessary for improved biodegradability and other properties, a multi-filtered cigarette as illustrated in FIG. 2A at 15*a* can incorporate more than one filter element. For example, the filter element 20*a* may include an additive such as activated charcoal and a further white polyvinyl alcohol filter element 20*b* may be provided at the mouthpiece end for appearance. Alternatively, the filter element 20*a* could be a less expensive, but still environmentally friendly, paper filter formed in any conventional manner, with the filter element 20*b* being made according to this invention and providing a more conventional fibrous appearance to the smoker.

Conventional processing lines for the production of tobacco smoke filter rods and, ultimately, tobacco smoke filter elements therefrom, are shown and described in many prior patents, including the aforementioned Berger patents, and Berger et al. U.S. Pat. No. 3,455,766, the subject matter of which is incorporated herein in its entirety, although modifications to individual elements thereof in order to produce polyvinyl alcohol tobacco smoke filters according to this invention, particularly in the pre-treatment of the fibrous tow prior to gathering and bonding the same into a porous rod, are necessary.

Figure 3:
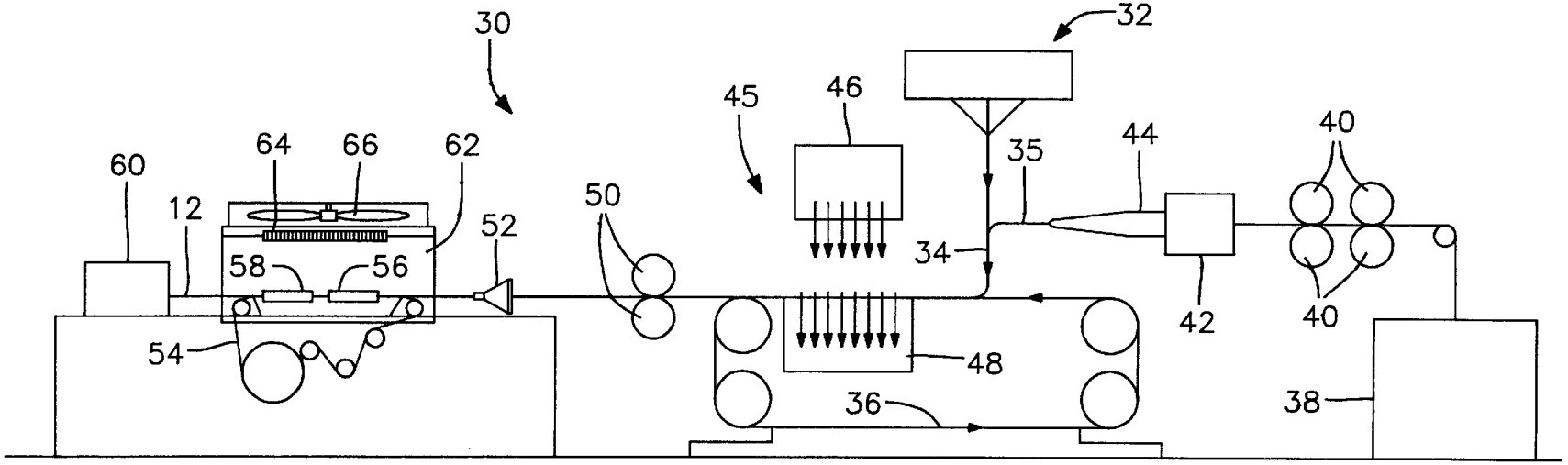
FIG. 3 is a schematic view of one form of a processing line for melt-blowing polyvinyl alcohol fibers and producing filter rods and elements therefrom in-line according to a preferred embodiment of the instant inventive concepts.

FIG. 3 schematically illustrates one form of a preferred processing line used for the manufacture of tobacco smoke filter rods and elements or the like comprising a matrix consisting essentially of polyvinyl alcohol fibers. The overall processing line is designated generally by the reference numeral 30. In the embodiment shown in FIG. 3, the polyvinyl alcohol fibers themselves are melt blown "in-line" with the equipment utilized to process the fibers into the porous elements. Such an arrangement is practical because of the small footprint of the equipment required for this procedure. While the in-line processing has obvious commercial advantages, it is to be understood that, in their broadest sense, the instant inventive concepts are not so limited. The polyvinyl alcohol fibers and webs or rovings formed from such fibers may be separately made and processed into diverse products according to this invention in independent or sequential operations.

Whether in-line or separate, the polyvinyl alcohol resin can be melt blown if finer fibers are desired. A melt blowing die is schematically shown in FIG. 3 at 32 as extruding and attenuating a multiplicity of polyvinyl alcohol fibers 34, which are received on a moving foraminous surface shown as a collection belt 36 in FIG. 3. Using melt blown techniques and equipment as illustrated, for example, in the aforementioned melt-blowing patents, the molten polyvinyl alcohol fibers are extruded into a high velocity air stream which attenuates the fibers. Commonly, cool air is directed transversely to the direction of extrusion and attenuation of the melt blown fibers to cool the fibers and enhance entanglement of the fibers, while minimizing bonding of the fibers to each other at this point in the processing, thereby retaining the fluffy character of the fibrous mass and increasing productivity.

While various materials may be added to the surface of the polyvinyl alcohol fibers formed in the melt blowing technique, including even a lubricant or a surfactant, unlike melt spun fibers which may require a lubricant to minimize friction and static in subsequent drawing operations, melt blown fibers generally do not require such surface treatments because they need not be further attenuated by drawing. The ability to avoid such additives may be important in certain applications where extraneous materials may interfere or react undesirably with the use of the porous element product of this invention.

If desired, however, liquid additives, preferably non-aqueous in nature, such as taste-modifiers, for example, menthol, may be sprayed onto the fibers 34 during the melt blowing process. Alternatively, such materials can be added to the polyvinyl alcohol fibrous web later in the processing line.

A stream of a particulate additive material may also be blown into the fibrous mass 34 as illustratively shown at 35 in FIG. 3. The particulate material can provide the ultimate product with any of a variety of enhanced properties. For example, activated carbon can be added to improve the gas phase filtration properties of tobacco smoke filter means formed from polyvinyl alcohol fibers according to this invention. Ground expanded sorghum particles, as discussed above, or other starch particles, can be incorporated into the fibrous web 34 to improve the hardness of the resultant rod or to add filtration properties thereto. Even tobacco particles may be added to provide improved taste to filter elements formed by the processing line 30.

Additionally, chopped cellulose acetate fibers may be added, as shown in FIG. 3, to provide the resultant tobacco smoke filter plugs with the familiar flavor of conventional cellulose acetate filter elements, if desired. Chopped fibers can be produced in-line as shown in FIG. 3 from a bale 38 of cellulose acetate tow, prepped in any conventional manner schematically shown at 40, cut into discrete lengths by the chopper 42, and blown through the funnel 44 into the polyvinyl alcohol tow 34 by any conventional means.

Regardless of the nature of the particulate additive, incorporating the same during the melt blowing technique insures uniform distribution throughout the fibrous web and excellent bonding within the porous matrix. Heretofore, it has been necessary to include an additional filter plug at the mouthpiece end of a cigarette incorporating a filter element with a particulate additive, such as activated charcoal, to protect the smoker from loose particles which may be drawn into his or her mouth during the smoking process. With the instant inventive techniques, such measures are obviated. However, as shown in FIG. 2A, the use of a multi-filter may be desirable for other reasons such as appearance.

For maximum biodegradability, the products of this invention are made substantially entirely of water soluble polyvinyl alcohol fibers, although the addition of water soluble starches, such as sorghum, will provide an equally environmentally acceptable, totally biodegradable, tobacco smoke filter or the like. For most practical purposes, the incorporation of additives in an amount of from about 10 to 30% by weight of the product, will provide a desired effect, without dramatically reducing the biodegradability of the product. However, substantially higher loading, for example, up to 60% by weight, of a material such as activated charcoal, may be used, if desired, to provide very high filtration efficiency, particularly gas phase filtration, while enabling the matrix to biodegrade in the presence of environmental water.

In a conventional melt blown technique, the polyvinyl alcohol fibers absorbs substantial moisture, on the order of about 15% to 20% or more. In order to enable such material to be processed according to the instant inventive concepts, it is necessary to pretreat the fibrous web 34 immediately prior to heating the same, as in the drying station 45, to reduce the residual moisture content to about 7% by weight or less. In the drying station 45, the web 34 is carried by the collection belt 36 past a heater 46 to drive off absorbed moisture, with water vapor so-produced being withdrawn by a vacuum 48. The temperature of the heat applied by the heater 46, and the length of the drying station 45, can be varied as necessary to produce the desired reduction in residual moisture content as the web 34 is withdrawn by the delivery rolls 50 and passed into the stuffer jet 52.

If the web 34 is in the nature of a fairly coherent sheet, it can be subjected to a process to break up its integrity, as schematically shown at 53 in FIG. 3, for example, by passing the same through an embossing station of the type illustrated in the aforementioned No. '005 Berger patent.

The pre-treated web 34 is gathered into a rod-like formation by a continuous foraminous belt 54 which is wrapped around the bundle of fibers to shape the same and carry the gathered fibers in a relaxed condition, without tension, through a first confined area 56 where they are subjected to superheated steam under pressure. The steam-treated fibers are then carried by the belt 54 through a second confined area 58, where the bonded fibers are cooled to form a substantially self-sustaining rod, such as the matrix 12 in FIG. 1, which is subsequently cut into individual or multiple filter elements by any standard cut-off means 60.

Figure 4:
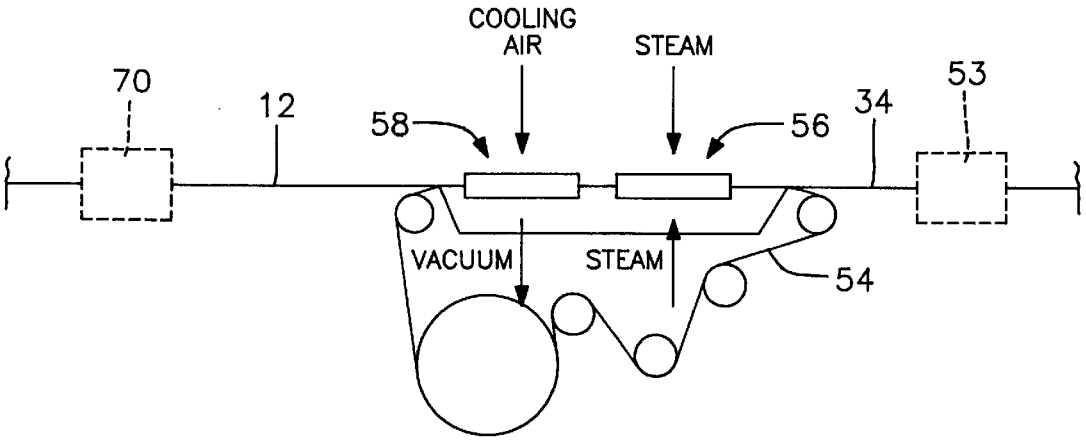
FIG. 4 is an enlarged schematic view of the garniture detail in the processing line of FIG. 3, with optional pre-embossing and post-coating stations schematically illustrated.

Details of a garniture such as illustrated in FIGS. 3 and 4, including the steam treating station 56 and the air cooling station 58, may be found in the aforementioned Berger et al. No. '766 and other Berger patents. Both the steam and the air may be circumferentially injected into the gathered polyvinyl alcohol fibers at an angle in the direction of travel of the fiber bundle, at an angle counter-currently thereto, or diametrically, the latter approach being illustrated in FIG. 4.

In any event, in the steam-treating station 56, superheated steam, on the order of 250° F. to 350° F. is passed circumferentially through the foraminous belt 54 into the mass of gathered polyvinyl alcohol fibers rendering the fiber surfaces adhesive and enabling the fibers to bond to each other at their points of contact. Thereafter, the belt 54 carries the continuous rod-like porous element through the air cooling station 58 to set the fibers in their bonded state.

To ensure penetration of the steam to the very center of the rod-shaped bundle of fibers in the first confined area 56, the steam must be in its molecular structure. That is, the steam must have a low water content and a high water vapor content. If the steam condenses prematurely, excessive fiber disintegration, poor bonding and processing problems will result. Thus, the steam is preferably superheated, beyond its point of condensation, and the equipment is maintained at an elevated temperature by enclosing the same in an oven 62 in order to avoid excessive condensation. The oven 62, which comprises a heating element 64 and a fan 66, is designed to maintain the environment at a temperature of at least about 250° F. to minimize excessive condensation of the steam and to exclude ambient moisture.

Although not shown, the polyvinyl alcohol fibrous rod may be overwrapped in any conventional manner as described, for example, in some of the prior Berger patents, with a standard paper plug wrap after the rod is formed. Alternatively, as illustrated in FIG. 4, the rod-like matrix of polyvinyl alcohol fibers bonded to each other at spaced points of contact exiting the air cooling station 58, may optionally be passed through an extruding station shown schematically at 70, to encase the matrix in a film or sheath of biodegradable polyvinyl alcohol or the like, thereby permitting even the overwrap of a filter plug produced by this invention to disintegrate in the presence of environmental water.

Figure 5:
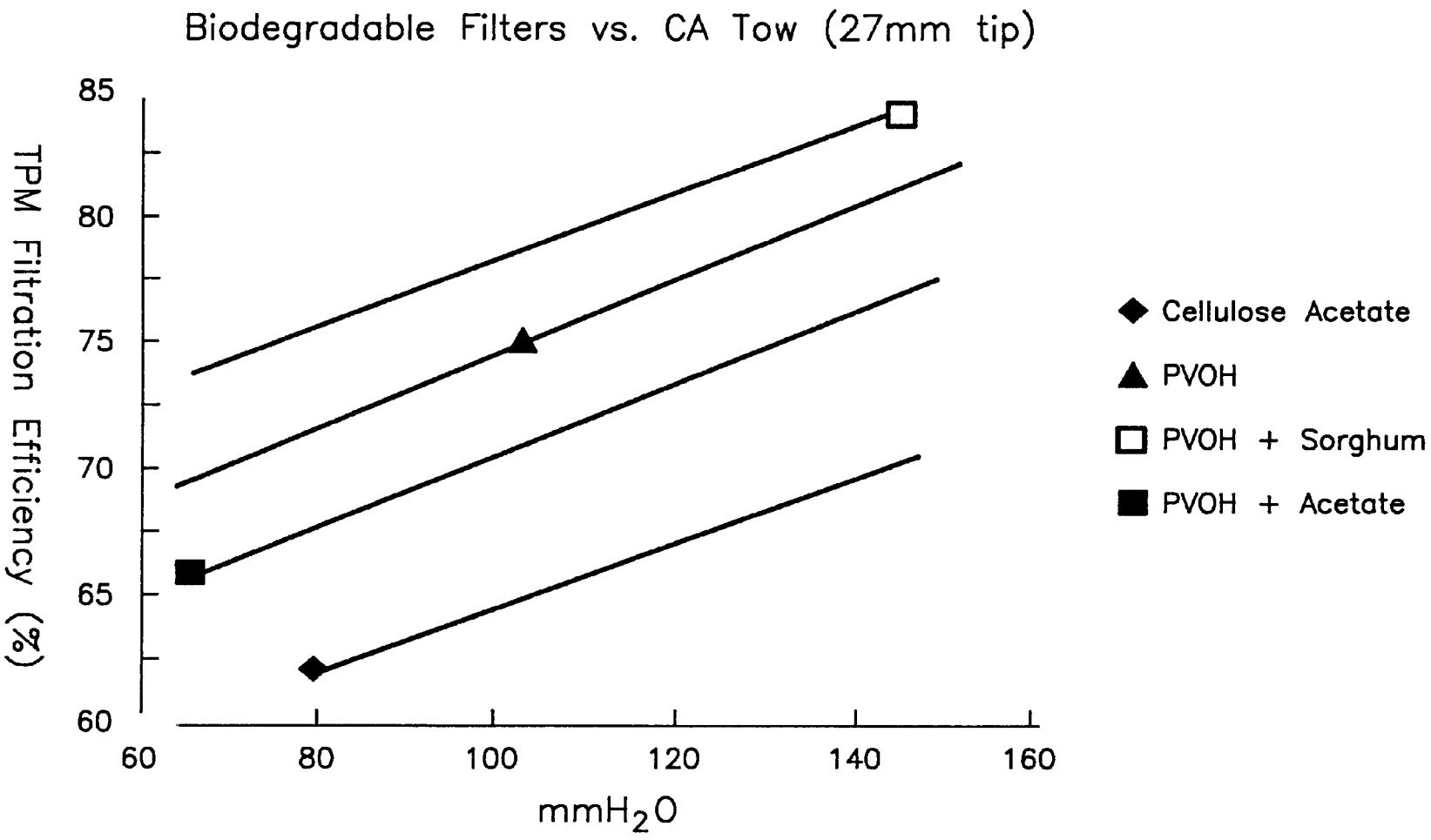
FIG. 5 is a graph illustrating the total particulate matter filtration efficiency of biodegradable filters formed from polyvinyl alcohol fibers alone, or incorporating sorghum or cellulose acetate fibers, and comparing the same with conventional prior art cellulose acetate filter elements.

Although the instant inventive concepts are primarily directed to the provision of biodegradable tobacco smoke filter elements to reduce environmental litter, the tobacco smoke filter elements of this invention also have other improved properties vis-a-vis prior art products. For example, by reference to FIG. 5, it will be seen that, at substantially all commercially significant pressure drop levels, tobacco smoke filter elements formed of polyvinyl alcohol (PVOH) according to the instant invention, have improved total particulate matter filtration efficiency as compared with conventional cellulose acetate (CA) filter elements of the same dimensions. Moreover, polyvinyl alcohol filter elements incorporating even up to 30% by weight of chopped cellulose acetate fibers, still provide higher filtration efficiency than filter elements formed entirely of cellulose acetate. Finally, the incorporation of sorghum in a polyvinyl alcohol filter as discussed above, enhances the filtration efficiency of the polyvinyl alcohol filter itself by, on average, an additional 5%.

Reference is now made to Table 1 which illustrates the effect of pre-drying the polyvinyl alcohol web on the ability to process the same into a commercially acceptable product.

TABLE 1

EFFECT OF PRE-DRYING

| Example | 1 | 2 | 3 | 4 |
|---|---|---|---|---|
| PVOH | | | | |
| Mass rate, g/min | 10.8. | 10.8 | 10.8 | 10.8 |
| Linear speed, m/min | 10 | 10 | 10 | 10 |
| Diameter, mm | 8.1 | 8.1 | 8.1 | 8.1 |

TABLE 1-continued

| EFFECT OF PRE-DRYING | | | | |
|---|---|---|---|---|
| Example | 1 | 2 | 3 | 4 |
| Drying | | | | |
| Time in oven, min | 0 | 15 | 30 | 60 |
| Weight loss, % | 0 | 5.6 | 8.2 | 9.1 |
| Residual moisture, % | 15 | 9.4 | 6.8 | 5.9 |
| Steam pressure, psig | | | | |
| Block | 3 | 3 | 3 | 3 |
| Steam temperature, °F. | | | | |
| Heater | 435 | 435 | 435 | 435 |
| Block | 280 | 280 | 280 | 280 |
| Steam Die Cavity | 258 | 258 | 258 | 258 |
| Absorbed water, % | 2.7 | 1.9 | 3.6 | 3.76 |
| Processability | Poor | Poor | Fair | Good |
| Bonding | Poor | Poor | Fair | Good |

By comparing Examples 3 and 4 in Table 1 with Examples 1 and 2, it will be seen that, all other parameters being the same, pre-drying the polyvinyl alcohol starting material to a level below about 7% by weight, produces acceptable ("fair" or "good") processability and bonding of the contact points between the fibers. In Examples 3 and 4, the residual moisture in the polyvinyl alcohol web starting material, in combination with water absorbed during the steam treating step, remained under about 10% total, whereas, in Examples 1 and 2, the residual moisture in the initial polyvinyl alcohol web was well over 7%, and the total moisture content exceeded 10%, resulting in commercial unacceptable ("poor") bonding and processability.

Table 2 shows the impact of variations in the steam properties on the bonding process.

TABLE 2

| EFFECT OF STEAM VARIABLES ON THE BONDING PROCESS | | | | | | | |
|---|---|---|---|---|---|---|---|
| Example | 5 | 6 | 7 | 8 | 9 | 10 | 11 |
| PVOH | | | | | | | |
| Mass rate, g/min | 108 | 108 | 108 | 108 | 108 | 108 | 108 |
| Linear speed, m/min | 10 | 10 | 10 | 10 | 10 | 10 | 10 |
| Diameter, mm | 8.1 | 8.1 | 8.1 | 8.1 | 8.1 | 8.1 | 8.1 |
| Drying | | | | | | | |
| Weight loss, % | 9.8 | 11.5 | 9.9 | 8.6 | 9.8 | 12.3 | 13.3 |
| Residual moisture, % | 5.2 | 3.5 | 5.1 | 6.4 | 5.2 | 2.7 | 1.7 |
| Steam pressure, psig | | | | | | | |
| Block | 4 | 4 | 4 | 5 | 9 | 9 | 9 |
| Steam temperature, °F. | | | | | | | |
| Heater | 300 | 435 | 435 | 435 | 300 | 435 | 375 |
| Block | 212 | 330 | 330 | 330 | 212 | 330 | 300 |
| Steam Die Cavity | 212 | 248 | 260–290 | 290–300 | 212 | 306–326 | 280 |
| Absorbed water, % | — | 2.9 | 3 | 3.6 | — | — | |
| Processability | Stuck in belt | Good | Good | Good | Bad Disintegrates | Bad Disintegrates | Bad Disintigrates |
| Bonding | No bond in core | Good | Good | Excessive (Some Fusing) | | | |

The steam pressure in these tables can be equated to steam flow into the block. The heater sets the temperature of the steam in the superheater. The temperature of the block is significant in avoiding condensation. Of most importance is the steam die cavity temperature since this is the actual temperature of the steam exiting the block, i.e., the temperature of the steam experienced by the fibers as they are formed into the porous rod.

In each of Examples 5–11, the residual moisture in the polyvinyl alcohol web was maintained at less than 7% by weight. Yet, use of steam at relatively low temperatures, such as in Examples 5 and 9 (212° F.), produced unacceptable results. The high steam pressure in the block in Example 9 is believed to have exacerbated the problems in adding too much moisture at this stage. In the vicinity of about 250° F. (Example 6 shows "good" results at 248° F.), satisfactory product is produced. The fusing evidenced in the product of Example 8, believed to be the result of increased moisture produced by the higher steam pressure, was limited and marginally acceptable. Examples 10 and 11 are somewhat of an anomaly and the disintegration is believed to be the result of excessive add-on moisture, which could not be measured, produced by the higher steam pressure.

Finally, Table 3 further illustrates the interaction of moisture content, steam pressure and temperature, and production rates on bonding.

TABLE 3

| EFFECT OF VARIOUS PARAMETERS ON BONDING | | | | |
|---|---|---|---|---|
| Example | 12 | 13 | 14 | 15 |
| PVOH | | | | |
| Mass rate, g/min | 160 | 160 | 160 | 210 |
| Linear speed, m/min | 15 | 15 | 15 | 20 |
| Diameter, mm | 8.1 | 8.1 | 8.1 | 8.1 |

TABLE 3-continued

EFFECT OF VARIOUS PARAMETERS ON BONDING

| Example | 12 | 13 | 14 | 15 |
|---|---|---|---|---|
| Drying | | | | |
| Time in oven, min | 30 | 30 | 45 | 45 |
| Weight loss, % | 8.8 | 8.2 | 10 | 9.7 |
| Residual moisture, % | 6.2 | 6.8 | 5 | 5.3 |
| Steam pressure, psig | | | | |
| Block | 4.5 | 5.5 | 7.5 | 12 |
| Steam temperature, °F. | | | | |
| Heater | 435 | 435 | 435 | 435 |
| Block | 250 | 250 | 280 | 280 |
| Steam Die Cavity | 250 | 260 | 278 | 285 |
| Absorbed water, % | 3.85 | 3.56 | 3.4 | 3.1 |
| Processability | Poor | Poor | Good | Good |
| Bonding | Poor | Poor | Good | Good |

With higher total water content (Examples 12 and 13), the product stuck in the belt. Utilizing the same mass rate (Example 14), but with a lower residual moisture content in the polyvinyl alcohol web and higher steam temperature and pressure, "good" results were attained. Note that even with the higher steam pressure (flow) of Example 14, the add-on moisture is lower due to the higher block temperature which dries the steam in the cavity. Likewise, "good" results are possible with even higher mass rates and linear speeds, as well as higher steam temperatures and pressures, as shown in Example 15. However, when the web is improperly dried as in Examples 12 and 13, it cannot be processed even at slower speeds.

From the foregoing, it will be recognized that there are a number of interactive variables that must be carefully monitored and controlled in order to produce an acceptable porous rod wherein the matrix is formed of fibers consisting essentially of polyvinyl alcohol. Of particular importance are the residual moisture in the polyvinyl alcohol web entering the heating and cooling stations, the use of steam, and the nature and properties of the steam utilized, to heat the web and add moisture thereto as the gathered polyvinyl alcohol fiber web passes through and from the steam treating station to render the surfaces of the fibers adhesive and bondable and to lubricate the same, and the production speeds or residence time of the matrix-forming material in the various forming zones, particularly in the steam treating station. Although generally acceptable ranges for these important variables are set forth herein, it should be understood that one with ordinary skill in the art, having the instant disclosure as a guide, will be able to select particular parameters within these ranges to effect the optimum results.

Thus, while preferred embodiments and processing parameters and equipment have been shown and described herein, it is to be understood that these examples are illustrative and can be varied within the skill of the art without departing from the instant inventive concepts. Moreover, the invention is not limited by the specific details and illustrative examples disclosed herein and modifications can be made within the scope of the accompanying claims.

I claim:

1. In a substantially self-sustaining shaped porous element comprising a three-dimensional matrix formed of continuous polymeric fibers bonded to each other at spaced points of contact to define interstitial spaces therebetween forming a tortuous path therethrough, the improvement which comprises:

at least the majority of said fibers consisting essentially of polyvinyl alcohol soluble in water at a temperature of at least about 32°, so that the matrix will rapidly disintegrate in the presence of environmental moisture.

2. A tobacco smoke filter element comprising a discrete length of a porous element according to claim 1 which is generally cylindrical in shape.

3. The filter element of claim 2, wherein at least 70% of the fibers forming said matrix by weight consist essentially of polyvinyl alcohol.

4. The filter element of claim 2, wherein substantially all of the fibers forming said matrix consist essentially of polyvinyl alcohol.

5. The filter element of claim 2, wherein the polyvinyl alcohol has a hydrolysis level of no more than 95%.

6. The filter element of claim 5, wherein the polyvinyl alcohol has a hydrolysis level of at least about 65%.

7. The filter element of claim 2, wherein said polyvinyl alcohol fibers, on the average, have a diameter of 30 microns or less.

8. The filter element of claim 7, wherein said polyvinyl alcohol fibers, on the average, have a diameter of about 10 microns or less.

9. The filter element of claim 2, further including a sheath of polyvinyl alcohol circumscribing said matrix.

10. The filter element of claim 2, wherein said matrix is overwrapped in a paper plug wrap.

11. The filter element of claim 10, further including an additive material randomly dispersed throughout said matrix.

12. The filter element of claim 11, wherein said additive material comprises a solid particulate material.

13. The filter element of claim 12, wherein said additive material is a water soluble starch.

14. The filter element of claim 13, wherein said starch is sorghum.

15. The filter element of claim 14, wherein said additive material comprises ground expanded sorghum, and said sorghum is present in an amount of from about 10 to 30% by weight.

16. The filter element of claim 12, wherein said additive material is activated charcoal.

17. The filter element of claim 16, wherein said activated charcoal is present in an amount of from about 10 to 60% by weight.

18. The filter element of claim 12, wherein said additive material is chopped acetate fibers.

19. The filter element of claim 18, wherein said cellulose acetate fibers are present in an amount from about 10% to 30% by weight.

20. The filter element of claim 12, wherein said additive material is tobacco.

21. The filter element of claim 20, wherein said tobacco is present in an amount of from about 10 to 30%.

22. A tobacco smoke filter rod comprising a multiplicity of tobacco smoke filter elements according to claim 2, integrally connected to each other in end-to-end relationship.

23. A tobacco smoke filter rod according to claim 22, wherein the periphery of said rod is encased in a sheath of polyvinyl alcohol.

24. A tobacco smoke filter rod according to claim 22, wherein the rod is overwrapped with paper plug wrap.

25. A cigarette comprising a tobacco portion and a filter portion, wherein said filter portion comprises at least one filter element according to claim 2.

26. The cigarette of claim 25, wherein the periphery of said filter element is encased in a sheath of polyvinyl alcohol.

27. The cigarette of claim 25, wherein said filter element is overwrapped with paper plug wrap.

28. The cigarette of claim 25, wherein said filter portion includes two filter elements according to claim 2, a first filter element juxtaposed to the tobacco portion incorporating from 10–60% by weight of activated charcoal, and a second filter element forming the mouthpiece end of the cigarette being substantially free of activated charcoal.

29. The cigarette of claim 25, wherein said filter portion includes two filter elements, a first filter element juxtaposed to the tobacco portion being formed of paper, and a second filter element forming the mouthpiece end of the cigarette being according to claim 2.

30. The cigarette of claim 25, wherein said tobacco portion and said filter portion are connected to each other by a paper tipping overwrap.

31. In a method of making self sustaining porous elements including the steps of providing a multiplicity of continuous polymeric fibers with the fibers contacting each other at spaced points, gathering the fibers into a rod-like formation, heating the gathered fibers to render the same bondable at the spaced points of contact, cooling the resultant element to form a continuous rod, and subdividing the rod to form discrete elements each of which comprises a porous matrix formed by the fibers and defining a tortuous interstitial path therethrough, the improvement comprising:

at least the majority of said fibers consisting essentially of polyvinyl alcohol polymer, wherein the moisture content of the fibers prior to heating is maintained at about 7% by weight or less, and the gathered fibers are heated by contacting them with steam to add from about 2.5 to 5% by weight of moisture to a total moisture content of from about 2.5 to about 10% by weight, thereby rendering the surface of the polyvinyl alcohol fibers adhesive.

32. The method of claim 31, wherein said polyvinyl alcohol fibers initially contain in excess of about 7% moisture content, including the step of pre-treating said fibers prior to steam heating the same to reduce the moisture content thereof to about 7% by weight or less.

33. The method of claim 32, wherein a web of polyvinyl alcohol fibers is pre-treated by passing said fibers through a heating zone at a temperature sufficient to vaporize at least some of the moisture from said fibers, and withdrawing the water vapor so-produced under vacuum.

34. The method of claim 31, wherein said polyvinyl alcohol fibers are heated by contacting the same with superheated steam at a temperature range of between about 250° F. to 350° F. to soften the surface of said fibers at least at the spaced points of contact and render the same adhesive.

35. The method of claim 31, wherein said polyvinyl alcohol fibers are passed through a confined area to gather said fibers into a rod-like formation, and the steam is passed into said confined area.

36. The method of claim 35, wherein said fibers are carried by a foraminous belt in a relaxed condition through said confined area, and the steam is passed circumferentially through said belt under pressure into contact with said fibers.

37. The method of claim 36 wherein, substantially immediately following the steam treating step, said polyvinyl alcohol fibers are passed through a further confined area, and cooling gas is passed into said further confined area to set said fibers in their bonded condition.

38. The method of claim 31, further including extruding a sheath of biodegradable polyvinyl alcohol over the continuous rod as it is formed.

39. The method of claim 31, further comprising overwrapping the continuous rod with a paper plug wrap as it is formed.

40. The method of claim 31, further including melt blowing said polyvinyl alcohol fibers by contacting the same with a gas under pressure as they are formed and while they are still in a molten state to thereby attenuate said fibers and produce a web or roving of randomly dispersed, highly entangled, melt blown fibers, said web or roving being pre-treated to dry the same and then being gathered into the rod-like formation.

41. The method of claim 40, wherein said fibers are attenuated sufficiently to produce a web or roving of fibers having an average diameter of about 10 microns or less.

42. The method of claim 40, further including dispersing particles of starch throughout said fibers during the melt blowing step.

43. The method of claim 42, wherein said starch is ground expanded sorghum.

44. The method claim 40, further including dispersing particles of activated carbon throughout said fibers during the melt blowing step.

45. The method of claim 40, further including dispersing chopped cellulose acetate fibers throughout said fibers during the melt blowing step.

46. The method of claim 40, further including dispersing tobacco particles throughout said fibers during the melt blowing step.

47. The method of claim 40, wherein said melt blown fibers are collected on a continuously moving foraminous belt to form a web or roving, said web or roving being dried by heating one surface thereof to vaporize moisture absorbed by said polyvinyl alcohol fibers during the melt blowing process, and withdrawing the water vapor so-produced from the other surface of said web or roving by pulling a vacuum through said belt.

48. The product of the process of claim 31.

49. In an apparatus for making self-sustaining porous element including means for providing a continuous filamentary tow formed of a multiplicity of polymeric fibers with the fibers contacting each other at spaced points, means for gathering the fibers into a rod-like formation, means for heating the gathered fibers to render the same bondable at the spaced points of contact, means for cooling the resultant element to form a continuous rod, and means for subdividing the rod to form discrete elements each of which comprises a porous matrix formed by the fibers and defining a tortuous interstitial path therethrough, the improvement comprising:

at least the majority of said fibers consisting essentially of polyvinyl alcohol polymer, further including, prior to the means for heating the gathered fibers, a drying zone for reducing the moisture of the polyvinyl alcohol fibers to less than about 7% by weight, and said means for heating the gathered fibers comprising means for contacting said fibers with superheated steam sufficient to add from about 2.5 to 5.0% by weight of moisture to a total moisture content of from about 2.5 to about 10% by weight, and thereby render the surface of said fibers adhesive.

50. The apparatus of claim 49, wherein said drying zone comprises a continuously moving foraminous belt for collecting the polyvinyl alcohol fibers and forming a web or roving therefrom, and means for heating the web or roving at a temperature sufficient to vaporize some of the moisture therefrom, and means for withdrawing the water vapor so-produced under vacuum.

51. The apparatus of claim 49, wherein the means for gathering the fibers into a rod-like formation comprises means defining a first confined area through which the fibers are passed, and the means for heating the gathered fibers comprises means for passing steam into said first confined area generally circumferentially.

52. The apparatus of claim 49, wherein the means for cooling the resultant element comprises means defining a second confined area through which the fibers are passed, and means for passing cooling gas into said second confined area.

53. The apparatus of claim 49, further including an oven, said means defining said first and second confined areas being enclosed within said oven, and said oven being heated to a temperature sufficient to substantially eliminate ambient moisture.

54. The apparatus of claim 49, further including means for extruding a sheath of polyvinyl alcohol over the continuous rod as it is formed.

55. The apparatus of claim 49, further including means for overwrapping the continuous rod with paper plug wrap as it is formed.

56. The apparatus of claim 49, further including means for extruding a multiplicity of polyvinyl alcohol fibers, means for contacting said fibers with a gas stream under pressure as they are formed and while they are still in a molten state to attenuate said fibers, means for collecting the attenuated fibers to produce a web or roving of randomly dispersed, highly entangled, melt blown fibers, said drying zone reducing the moisture of the fibers in said web or roving.

57. The apparatus of claim 56, further including means to disperse a particulate material throughout the gas stream used to attenuate the fibers.

58. The apparatus of claim 57, wherein said particulate material is a starch.

59. The apparatus of claim 58, wherein said starch is ground expanded sorghum.

60. The apparatus of claim 57, wherein said particulate material is activated charcoal.

61. The apparatus of claim 57, wherein said particulate material is chopped cellulose acetate fibers.

62. The apparatus of claim 57, wherein said particulate material is tobacco.

* * * * *